US008974078B2

(12) United States Patent
Lin

(10) Patent No.: US 8,974,078 B2
(45) Date of Patent: Mar. 10, 2015

(54) LAMP WITH ENHANCED LIGHTING ANGLE

(71) Applicant: Li-Yu Lin, New Taipei (TW)

(72) Inventor: Li-Yu Lin, New Taipei (TW)

(73) Assignee: Litatek Corporation, New Taipei (TW)

( * ) Notice: Subject to any disclaimer, the term of this patent is extended or adjusted under 35 U.S.C. 154(b) by 15 days.

(21) Appl. No.: 13/855,755

(22) Filed: Apr. 3, 2013

(65) Prior Publication Data

US 2014/0301081 A1 Oct. 9, 2014

(51) Int. Cl.

| | |
|---|---|
| ***F21S 4/00*** | (2006.01) |
| ***F21V 21/00*** | (2006.01) |
| ***F21K 99/00*** | (2010.01) |

(52) U.S. Cl.

CPC .. *F21V 21/00* (2013.01); *F21K 9/10* (2013.01)
USPC ..... 362/219; 362/217.01; 362/217.14; 362/249.02; 362/555

(58) Field of Classification Search

USPC ..... 362/217.01, 217.14, 219, 227, 249.01, 362/249.02, 249.06, 551, 555
See application file for complete search history.

(56) References Cited

U.S. PATENT DOCUMENTS

2012/0201023 A1* 8/2012 Yoneda ..... 362/218
2013/0010460 A1* 1/2013 Peil et al. ..... 362/217.14

* cited by examiner

*Primary Examiner* — Anh Mai
*Assistant Examiner* — Meghan Dunwiddie
(74) *Attorney, Agent, or Firm* — Alan D. Kamrath; Kamrath IP Lawfirm, P.A.

(57) ABSTRACT

A lamp includes a mounting frame, at least one supporting member, and a plurality of light emitting members. The mounting frame is provided with a connecting face. The supporting member is provided with a support portion and a connecting portion. The connecting portion of the supporting member is combined with the connecting face of the mounting frame. Each of the light emitting members is a light emitting diode (LED). Thus, the support portion of the supporting member has a convex arcuate shape to provide a wide-angle feature, and the light emitting members are arranged on the support portion of the supporting member in different angles and at different positions, so that the lighting angles of the light emitting members are complementary mutually to increase the whole lighting angle of the lamp.

6 Claims, 11 Drawing Sheets

LAMP WITH ENHANCED LIGHTING ANGLE

BACKGROUND OF THE INVENTION

1. Field of the Invention

The present invention relates to a lighting device and, more particularly, to a lamp for providing illumination.

2. Description of the Related Art

A conventional lamp "A" in accordance with the prior art shown in FIGS. 1 and 2 comprises a mounting frame "A1", a circuit board "A2" mounted on the mounting frame "A1", and a plurality of light emitting members "A3" mounted on the circuit board "A2". The mounting frame "A1" has two opposite ends each provided with two pins "A11". The circuit board "A2" has a planar shape. Each of the light emitting members "A3" is a light emitting diode (LED) with a smaller volume, a rapid reaction speed, a greater strength and a longer lifetime. In assembly, the mounting frame "A1" has the specification of T5 or T8 to satisfy a traditional fluorescent lamp so that the mounting frame "A1" can function as a conventional fluorescent tube and can be combined with the lamp socket of the traditional fluorescent lamp. In such a manner, the pins "A11" of the mounting frame "A1" are inserted into the lamp socket of the traditional fluorescent lamp to connect an external power supply electrically so that the electric power from the external power supply is transmitted through the pins "A11" of the mounting frame "A1" to the light emitting members "A3". When in use, the light emitting members "A3" emit light beams outward to provide an illuminating effect. Thus, the conventional lamp "A" can replace the traditional fluorescent lamp. In comparison, the traditional fluorescent lamp has a lighting angle of about three hundred and sixty degrees (360°). However, the maximum lighting angle of each of the light emitting members "A3" is about one hundred and twenty degrees (120°) as shown in FIG. 2, so that when the light emitting members "A3" emit light beams to provide an illumination, the top of the conventional lamp "A" produces a lighting dead corner and presents a dark shadow, thereby decreasing the lightness of the conventional lamp "A".

BRIEF SUMMARY OF THE INVENTION

In accordance with the present invention, there is provided a lamp, comprising a mounting frame, at least one supporting member connected with the mounting frame, and a plurality of light emitting members mounted on the supporting member. The mounting frame has two opposite ends each provided with two pins. The mounting frame is provided with a connecting face. The supporting member is provided with a support portion and a connecting portion. The support portion of the supporting member has a convex arcuate shape. The connecting portion of the supporting member is combined with the connecting face of the mounting frame. Each of the light emitting members is a light emitting diode (LED). Each of the light emitting members is mounted on a surface of the support portion of the supporting member, and is connected electrically with the pins of the mounting frame.

Preferably, the support portion of the supporting member has a width greater than that of the mounting frame, so that the support portion of the supporting member has two opposite sides protruding outward from two opposite sides of the mounting frame.

Preferably, the support portion of the supporting member has a width smaller than that of the mounting frame.

Preferably, the lamp further comprises a spacer mounted between the mounting frame and the supporting member. The spacer has a first surface combined with the connecting face of the mounting frame and a second surface combined with the connecting portion of the supporting member.

Preferably, the light emitting members are extended in a longitudinal direction of the supporting member. In addition, the light emitting members are arranged in three arrays along the support portion of the supporting member and are spaced equally from each other.

Alternatively, the light emitting members are extended in a longitudinal direction of the supporting member. In addition, the light emitting members are arranged in two arrays along the support portion of the supporting member and are located at the two opposite sides of the support portion of the supporting member.

Preferably, the mounting frame is made of a metallic material.

Preferably, the supporting member is a circuit board with a convex arcuate surface.

The primary objective of the present invention is to provide a lamp with an enhanced lighting angle (or irradiating field).

According to the primary advantage of the present invention, the support portion of the supporting member has a convex arcuate shape to provide a wide-angle feature, and the light emitting members are arranged on the support portion of the supporting member in different angles and at different positions, so that the lighting angles of the light emitting members are complementary mutually to increase the whole lighting angle of the lamp so as to enhance the lightness and brightness of the lamp.

According to another advantage of the present invention, the lighting angle of the light emitting members is greater than one hundred and eighty degrees (180°) so that the lamp has a better lighting effect.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
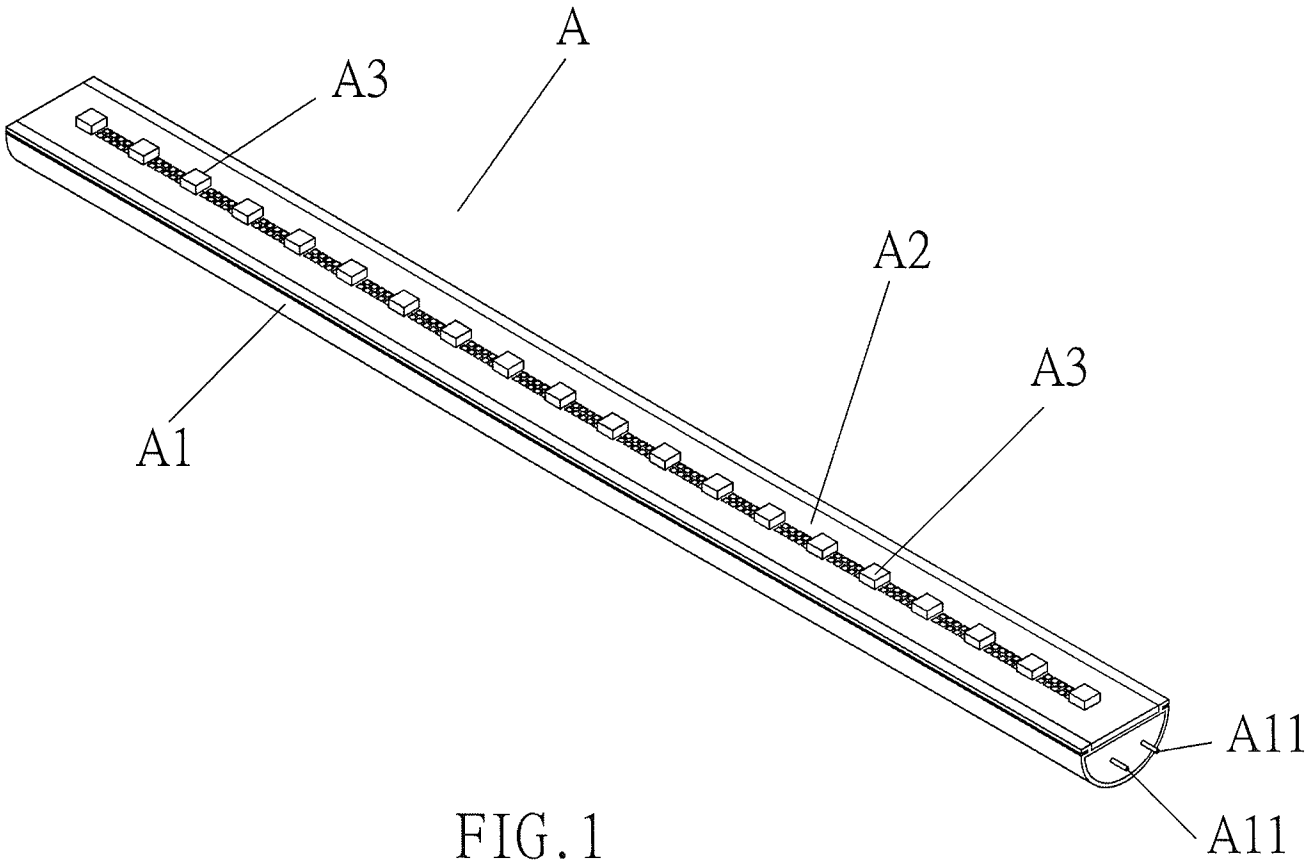
FIG. 1 PRIOR ART
FIG. 1 is a perspective view of a conventional lamp in accordance with the prior art.
Figure 2:
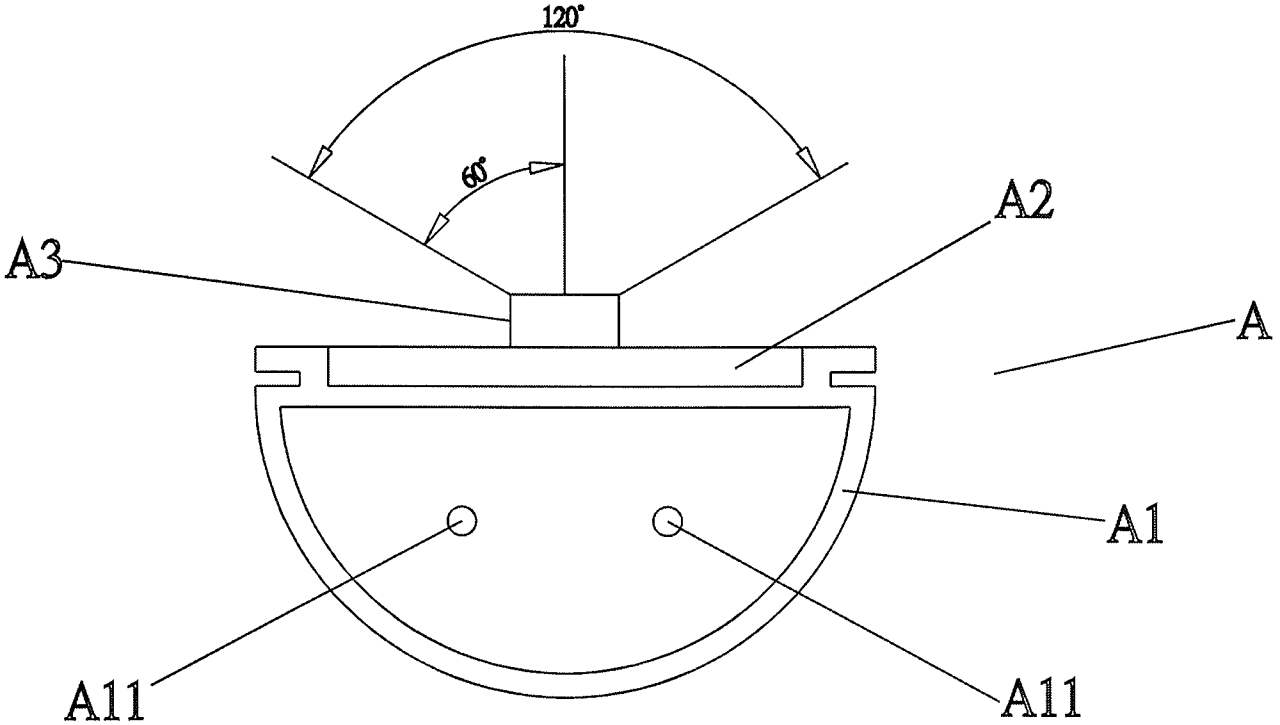
FIG. 2 PRIOR ART
FIG. 2 is a side cross-sectional view of the conventional lamp as shown in FIG. 1.
Figure 3:
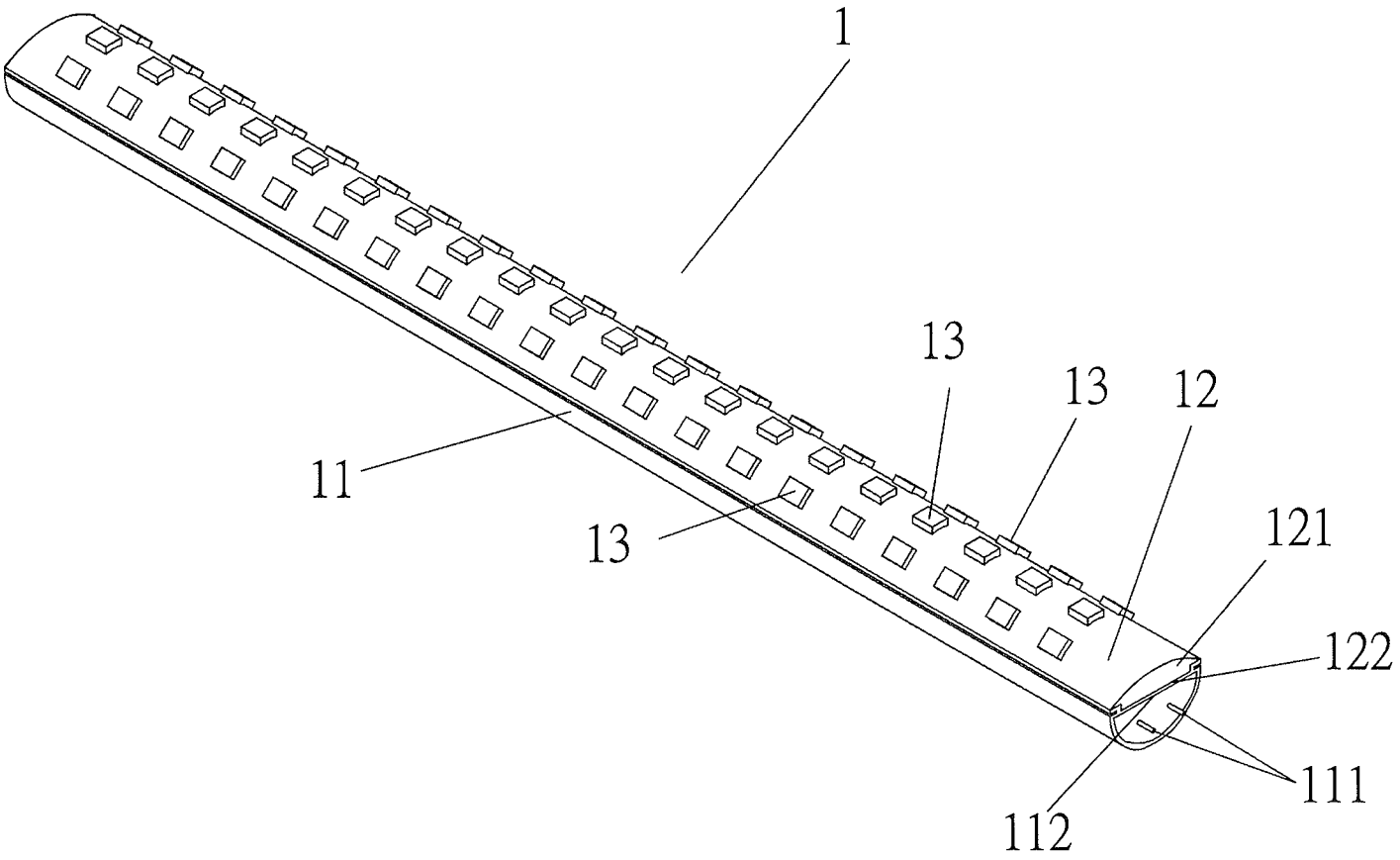
FIG. 3 is a perspective view of a lamp in accordance with the preferred embodiment of the present invention.
Figure 4:
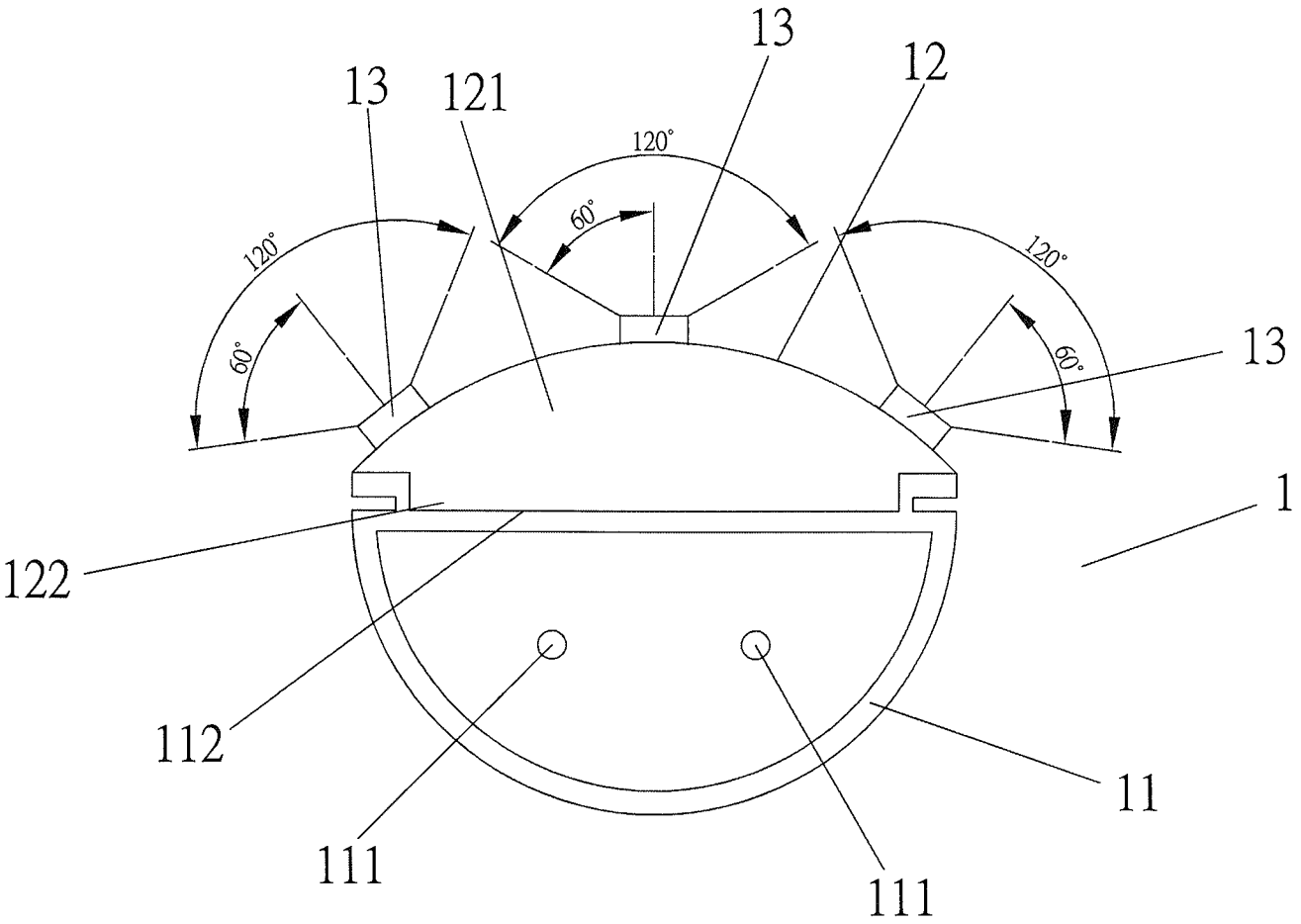
FIG. 4 is a side cross-sectional view of the lamp as shown in FIG. 3.

Referring to the drawings and initially to FIGS. 3 and 4, a lamp 1 in accordance with the preferred embodiment of the present invention comprises a mounting frame 11, at least one supporting member 12 connected with the mounting frame 11, and a plurality of light emitting members 13 mounted on the supporting member 12.

The mounting frame 11 is made of a metallic material, such as aluminum, aluminum alloy and the like. The mounting frame 11 has two opposite ends each provided with two pins 111. The mounting frame 11 is provided with a connecting face 112.

The supporting member 12 is preferably a circuit board with a convex arcuate surface. The supporting member 12 is provided with a support portion 121 and a connecting portion 122. The connecting portion 122 of the supporting member 12 extends and protrudes outward a bottom of the support portion 121. The support portion 121 of the supporting member 12 has a top having a convex arcuate shape so that the surface of the support portion 121 has a convex arcuate shape. The connecting portion 122 of the supporting member 12 is combined with the connecting face 112 of the mounting frame 11. In the preferred embodiment of the present invention, the connecting portion 122 of the supporting member 12 is bonded onto the connecting face 112 of the mounting frame 11 by an adhesive. Alternatively, the connecting face 112 of the mounting frame 11 is a slot, and the connecting portion 122 of the supporting member 12 is a plug, so that the connecting portion 122 of the supporting member 12 is inserted into the connecting face 112 of the mounting frame 11.

Each of the light emitting members 13 is a light emitting diode (LED). Each of the light emitting members 13 is mounted on a surface of the support portion 121 of the supporting member 12, and is connected electrically with the pins 111 of the mounting frame 11. Preferably, each of the light emitting members 13 is combined with the support portion 121 of the supporting member 12 by tin soldering. In the preferred embodiment of the present invention, the light emitting members 13 are extended in a longitudinal direction of the supporting member 12. In addition, the light emitting members 13 are arranged in three arrays along the support portion 121 of the supporting member 12 and are spaced equally from each other.

In assembly, the mounting frame 11 has the specification of T5 or T8 to satisfy a traditional fluorescent lamp so that the mounting frame 11 can function as a conventional fluorescent tube and can be combined with the lamp socket of the traditional fluorescent lamp. In such a manner, the pins 111 of the mounting frame 11 are inserted into electrically conducting slots of the lamp socket of the traditional fluorescent lamp to connect an external power supply electrically so that an electric power from the external power supply is transmitted through the pins 111 of the mounting frame 11 to the light emitting members 13. Thus, the light emitting members 13 emit light beams outward to provide an illuminating effect. The maximum lighting angle of each of the light emitting members 13 is about one hundred and twenty degrees (120°).

As shown in FIG. 4, the support portion 121 of the supporting member 12 has a convex arcuate shape to provide a wide-angle feature so that the light emitting members 13 are arranged on the support portion 121 of the supporting member 12 in different angles and at different positions to increase the lighting angle of the light emitting members 13 so as to enhance the lightness and brightness of the lamp 1. Preferably, the lighting angle of the light emitting members 13 is greater than one hundred and eighty degrees (180°).

Figure 5:
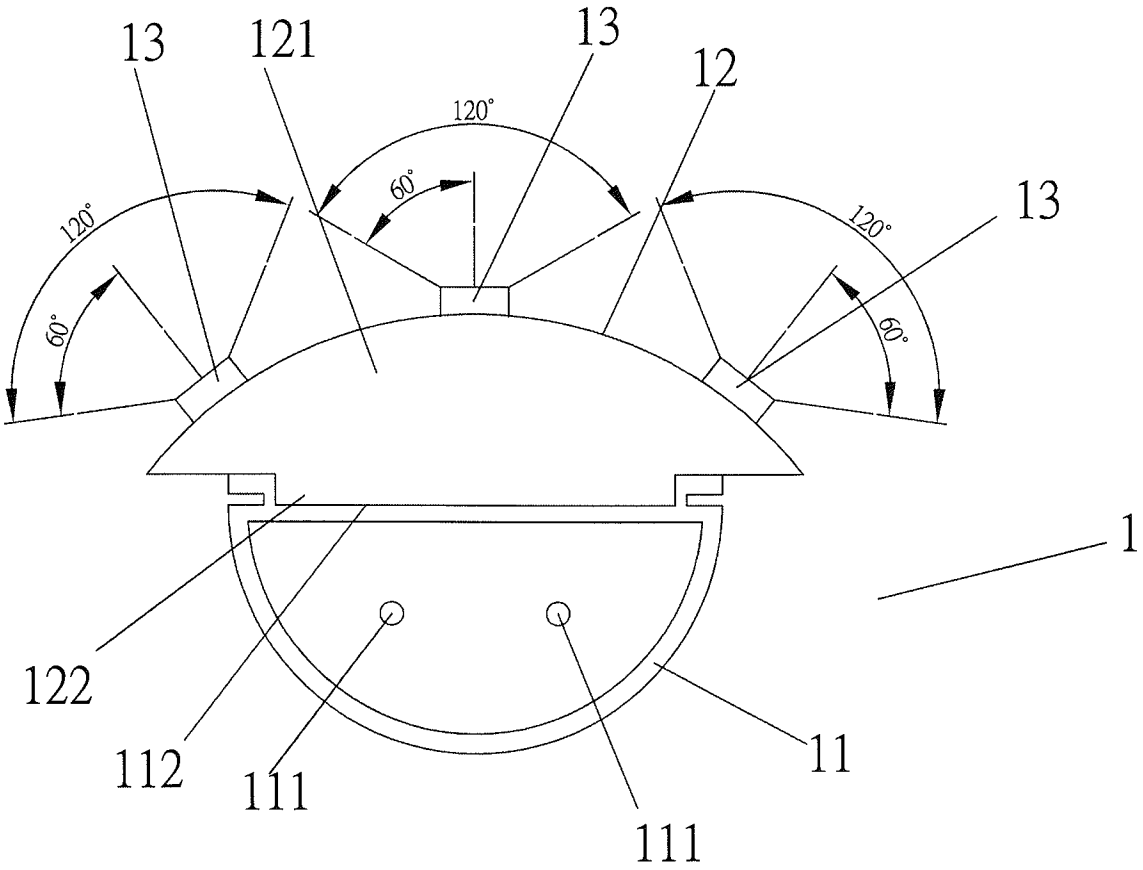
FIG. 5 is a side cross-sectional view of a lamp in accordance with another preferred embodiment of the present invention.

As shown in FIG. 5, the support portion 121 of the supporting member 12 has a width greater than that of the mounting frame 11, so that the support portion 121 of the supporting member 12 has two opposite sides protruding outward from two opposite sides of the mounting frame 11.

Figure 6:
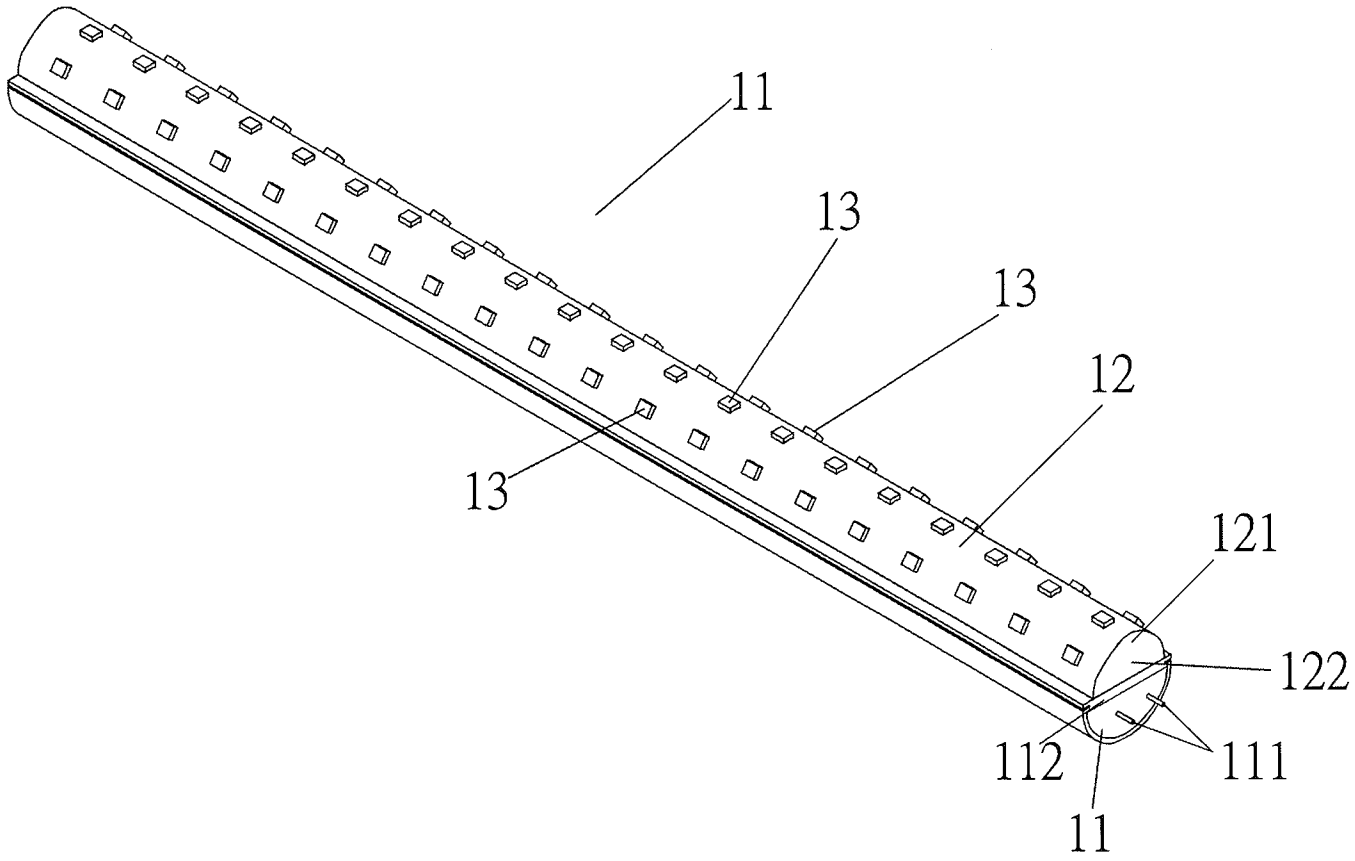
FIG. 6 is a perspective view of a lamp in accordance with another preferred embodiment of the present invention.

As shown in FIG. 6, the support portion 121 of the supporting member 12 has a width smaller than that of the mounting frame 11, so that the support portion 121 of the supporting member 12 has a larger radian.

Figure 7:
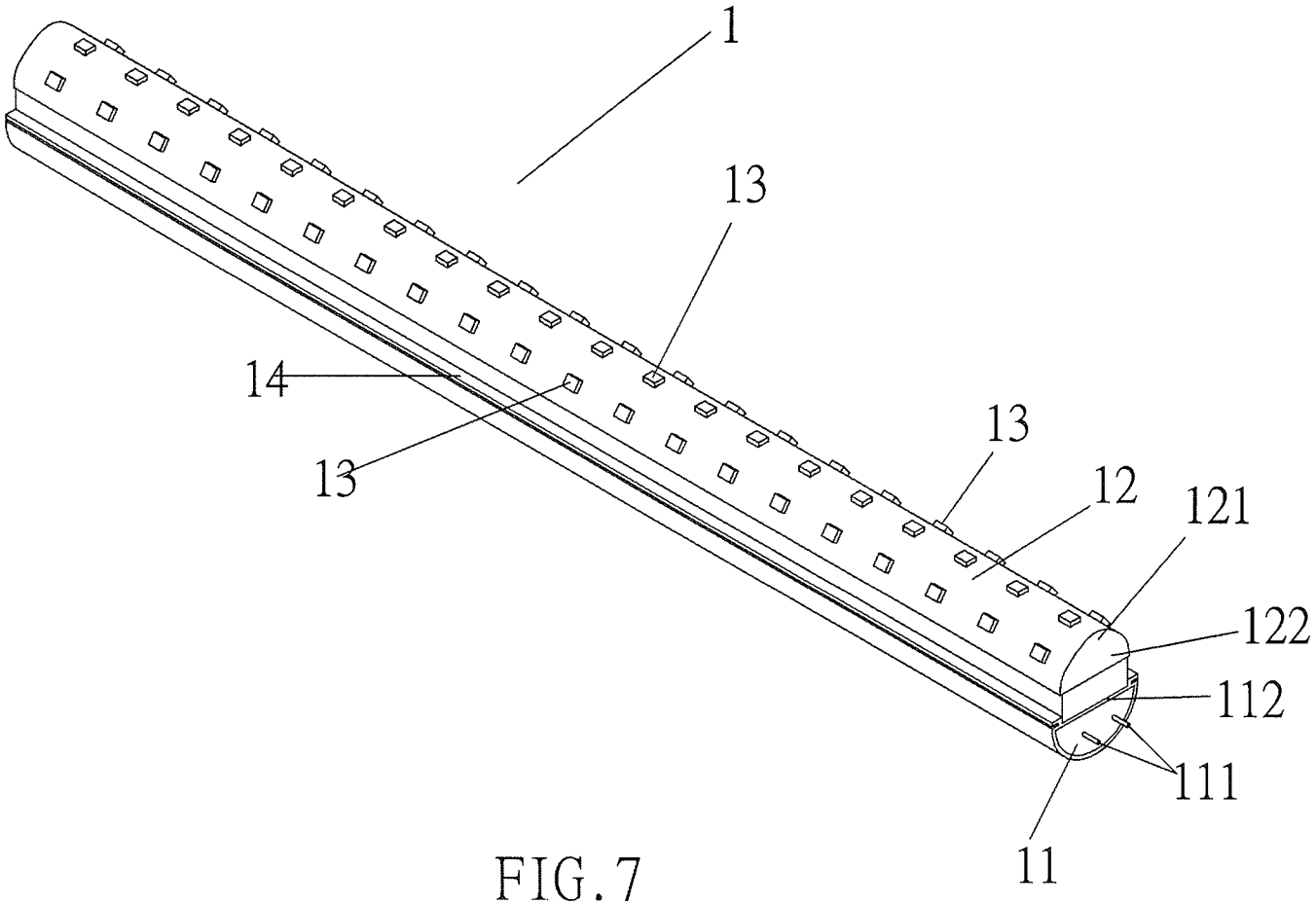
FIG. 7 is a perspective view of a lamp in accordance with another preferred embodiment of the present invention.
Figure 8:
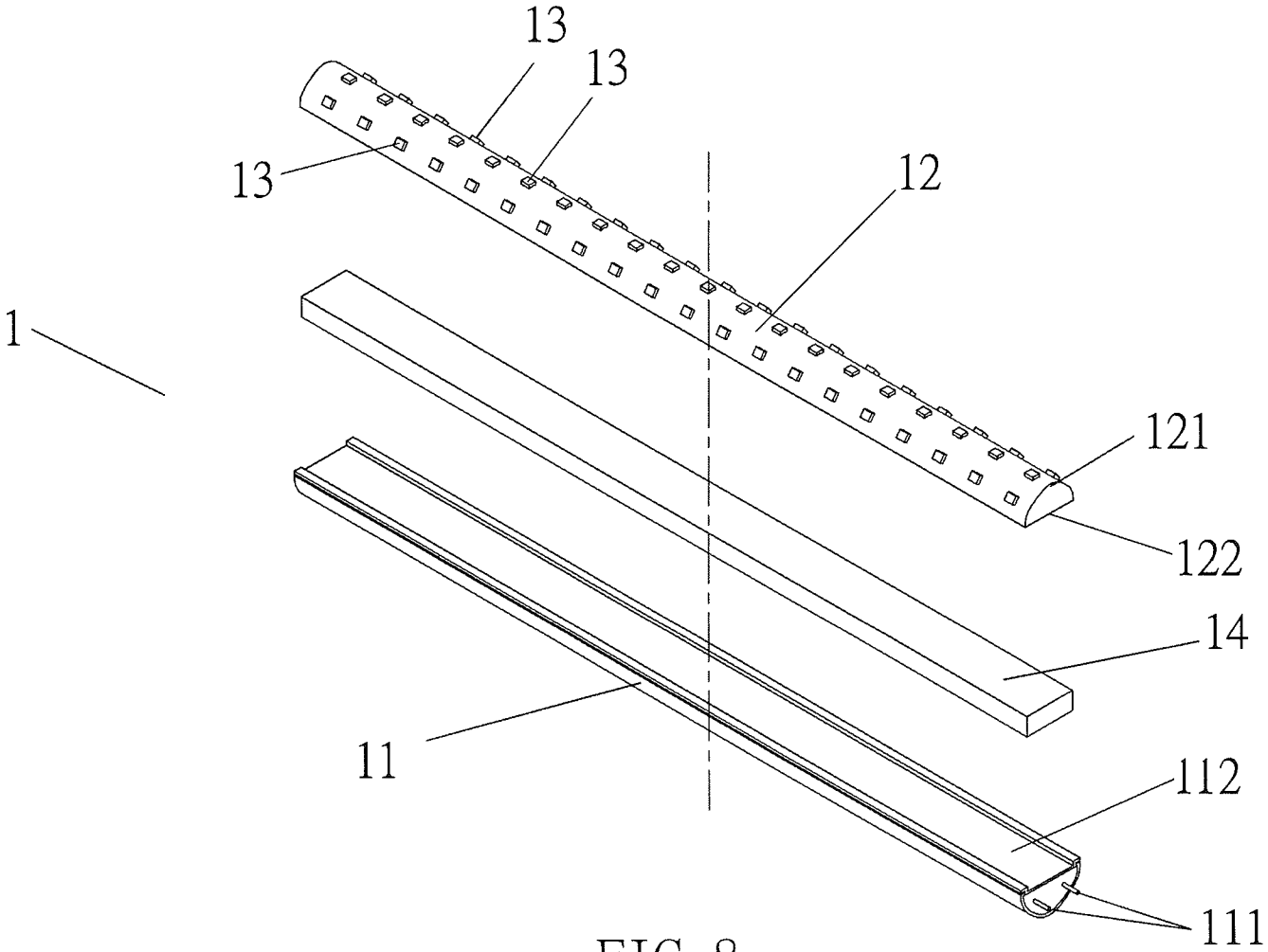
FIG. 8 is an exploded perspective view of the lamp as shown in FIG. 7.
Figure 9:
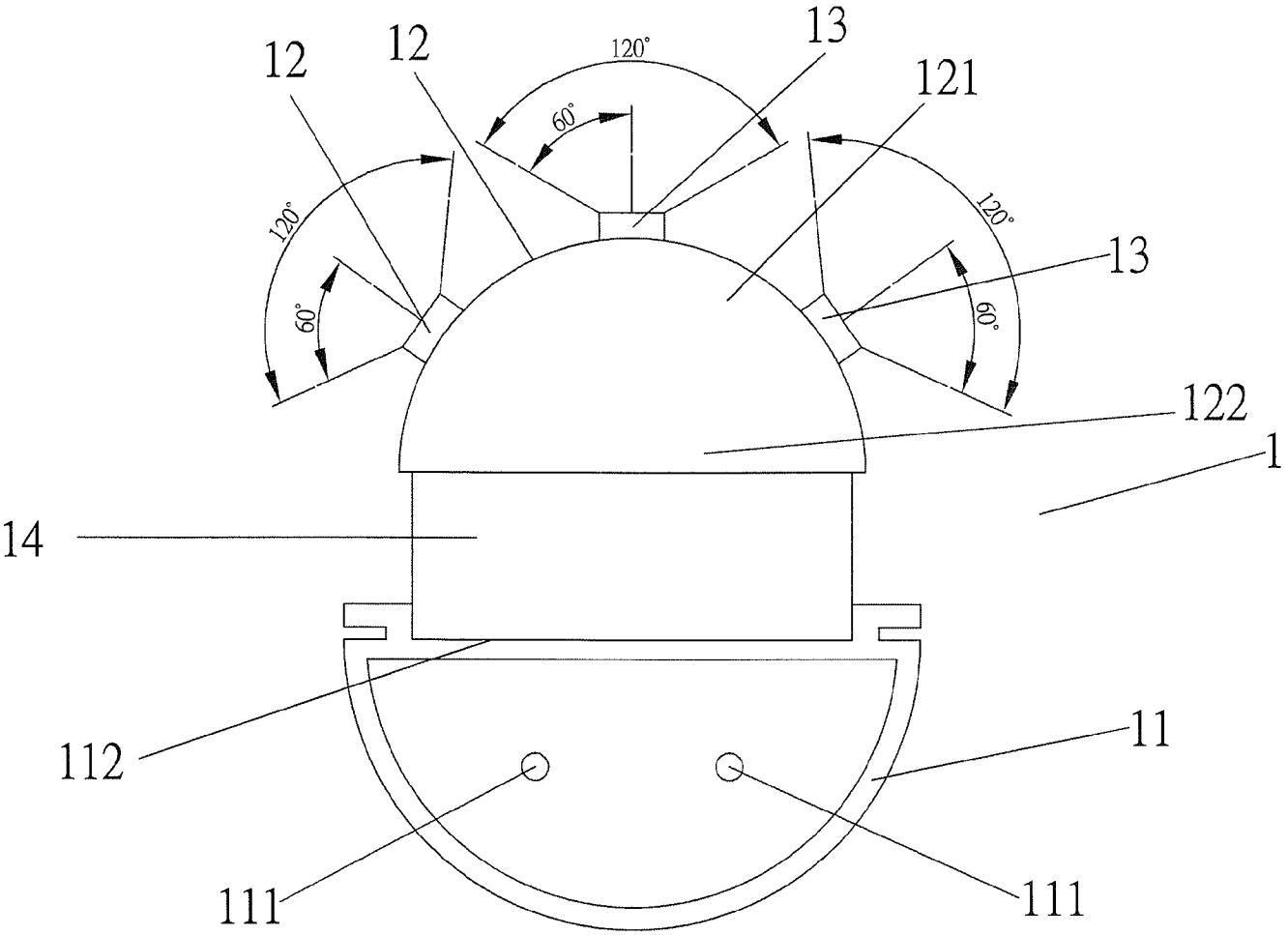
FIG. 9 is a side cross-sectional view of the lamp as shown in FIG. 7.

Referring to FIGS. 7-9, the lamp 1 further comprises a spacer 14 mounted between the mounting frame 11 and the supporting member 12 to increase the height of the supporting member 12, thereby preventing the light from the light emitting members 13 at the two opposite sides of the support portion 121 of the supporting member 12 from being obstructed by the mounting frame 11, so as to enhance the lighting angle of the lamp 1. The spacer 14 has a first surface combined with the connecting face 112 of the mounting frame 11 and a second surface combined with the connecting portion 122 of the supporting member 12.

Figure 10:
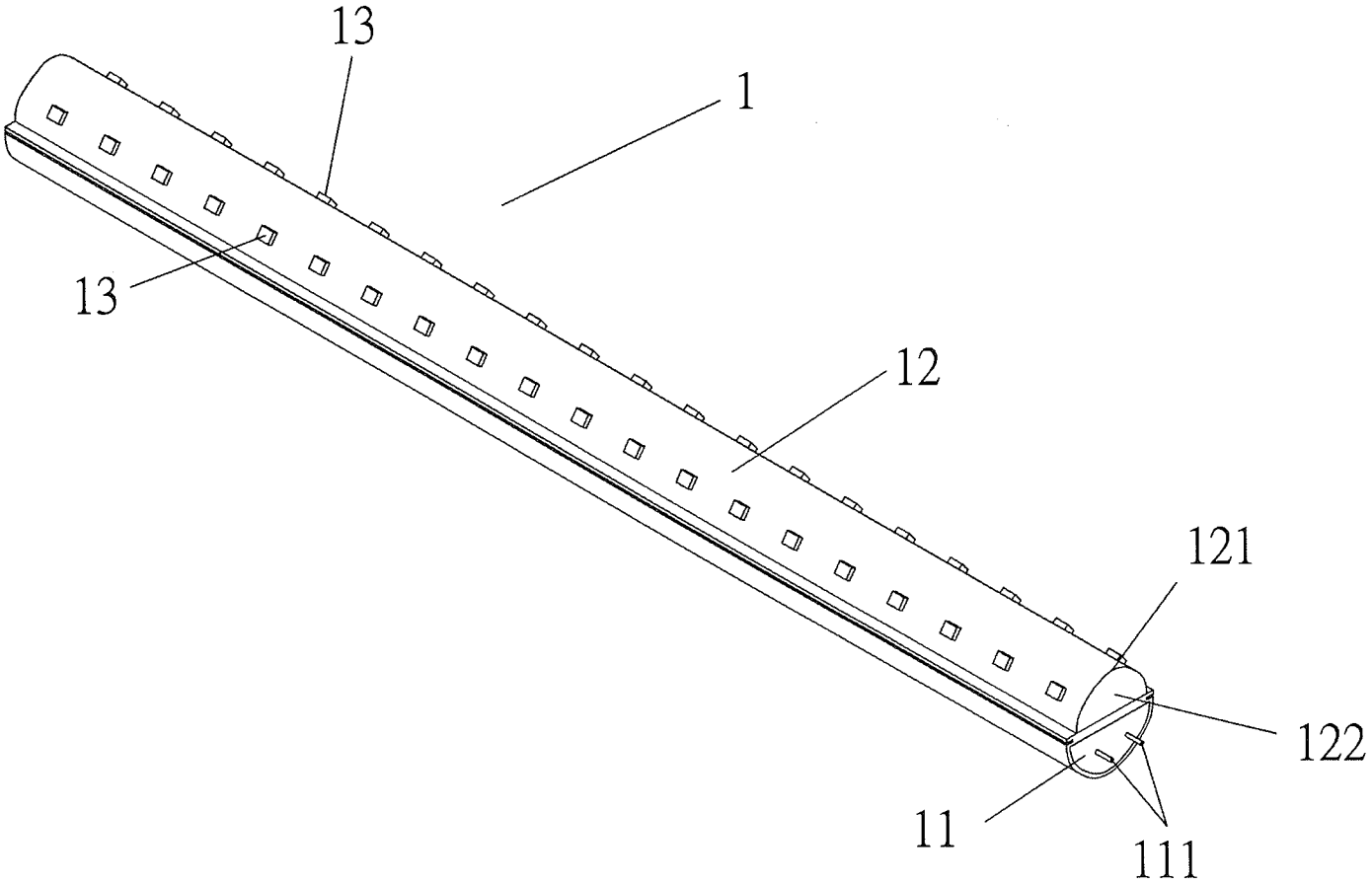
FIG. 10 is a perspective view of a lamp in accordance with another preferred embodiment of the present invention.
Figure 11:
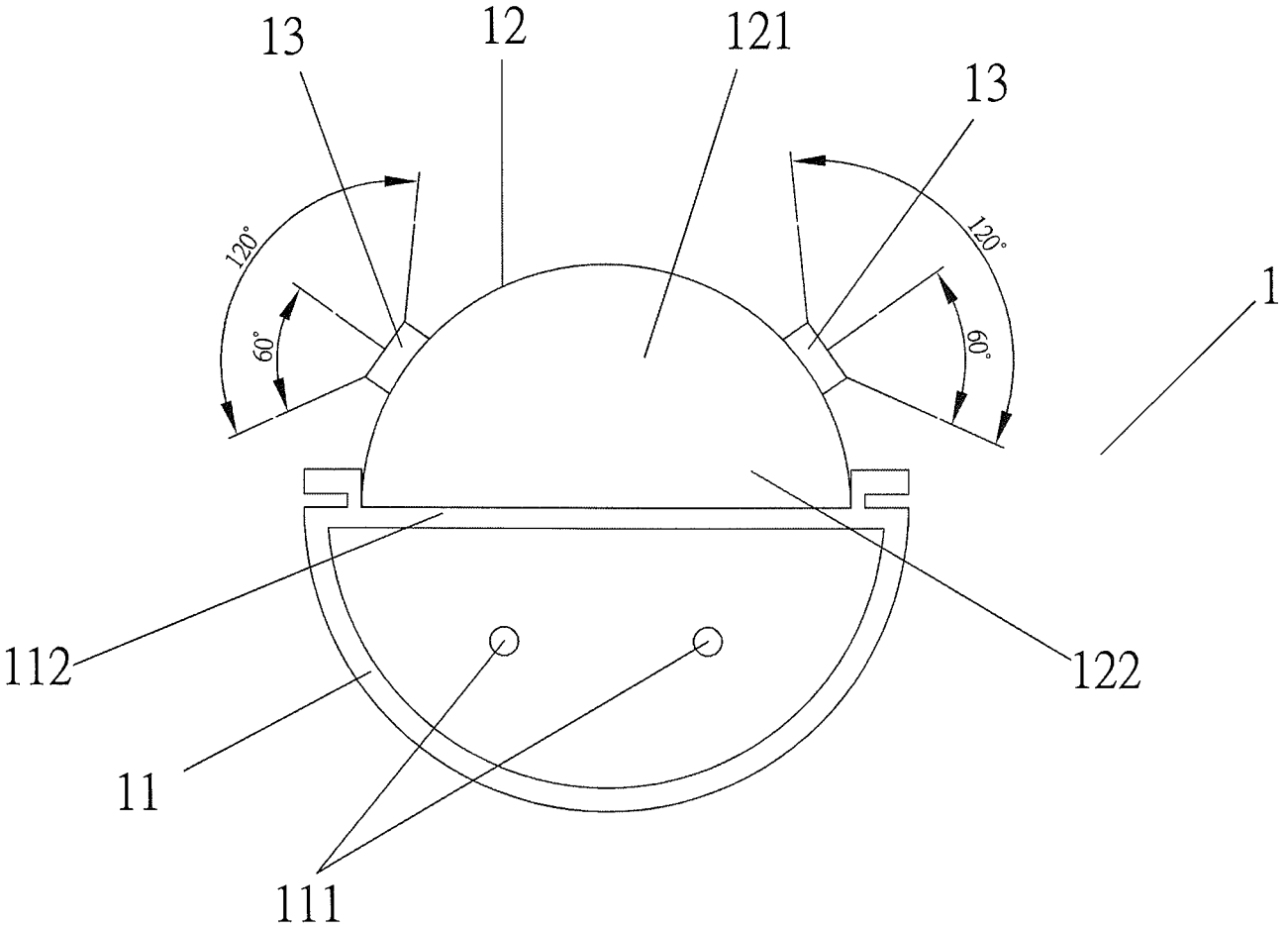
FIG. 11 is a side cross-sectional view of the lamp as shown in FIG. 10.

Referring to FIGS. 10 and 11, the light emitting members 13 are extended in a longitudinal direction of the supporting member 12. In addition, the light emitting members 13 are arranged in two arrays along the support portion 121 of the supporting member 12 and are located at the two opposite sides of the support portion 121 of the supporting member 12. Thus, the support portion 121 of the supporting member 12 has a convex arcuate shape to provide a wide-angle feature so that the light emitting members 13 are arranged on the support portion 121 of the supporting member 12 in two different angles to increase the lighting angle of the light emitting members 13 so as to enhance the lightness and brightness of the lamp 1. Preferably, the lighting angle of the light emitting members 13 is greater than one hundred and eighty degrees (180°).

Accordingly, the support portion 121 of the supporting member 12 has a convex arcuate shape to provide a wide-angle feature, and the light emitting members 13 are arranged on the support portion 121 of the supporting member 12 in different angles and at different positions, so that the lighting angles of the light emitting members 13 are complementary mutually to increase the whole lighting angle of the lamp 1 so as to enhance the lightness and brightness of the lamp 1. In addition, the lighting angle of the light emitting members 13 is greater than one hundred and eighty degrees (180°) so that the lamp 1 has a better lighting effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp comprising:

a mounting frame;

a supporting member connected with the mounting frame; and a plurality of light emitting members mounted on the supporting member, wherein:

the mounting frame has two opposite ends each provided with two pins;

the mounting frame is provided with a connecting face;

the supporting member is provided with a support portion and a connecting portion;

the support portion of the supporting member has a convex arcuate shape;

the connecting portion of the supporting member is combined with the connecting face of the mounting frame;

each of the plurality of light emitting members is a light emitting diode (LED);

each of the plurality of light emitting members is mounted on a surface of the support portion of the supporting member, and is connected electrically with the pins of the mounting frame;

the support portion of the supporting member has a width greater than that of the mounting frame; and the support portion of the supporting member has two opposite sides protruding outward from two opposite sides of the mounting frame.

2. The lamp of claim 1, further comprising a spacer mounted between the mounting frame and the supporting member; wherein the spacer has a first surface combined with the connecting face of the mounting frame and a second surface combined with the connecting portion of the supporting member.

3. The lamp of claim 1, wherein:

the plurality of light emitting members is extended in a longitudinal direction of the supporting member; and the plurality of light emitting members is arranged in three arrays along the support portion of the supporting member and is spaced equally from each other.

4. The lamp of claim 1, wherein:

the plurality of light emitting members is extended in a longitudinal direction of the supporting member; and the plurality of light emitting members is arranged in two arrays along the support portion of the supporting member and is located at the two opposite sides of the support portion of the supporting member.

5. The lamp of claim 1, wherein the mounting frame is made of a metallic material.

6. The lamp of claim 1, wherein the supporting member is a circuit board with a convex arcuate surface.

* * * * *